US007507452B2

(12) United States Patent
Odamura et al.

(10) Patent No.: US 7,507,452 B2
(45) Date of Patent: Mar. 24, 2009

(54) PRINTING METHOD USING PEARL PIGMENT

(75) Inventors: Kozo Odamura, Tokyo-To (JP); Takayuki Imai, Tokyo-To (JP); Shinichi Yunoki, Tokyo-To (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 10/677,122

(22) Filed: Oct. 1, 2003

(65) Prior Publication Data

US 2004/0209774 A1 Oct. 21, 2004

(30) Foreign Application Priority Data

Oct. 2, 2002 (JP) ..... 2002-290252

(51) Int. Cl.
*B41M 5/20* (2006.01)

(52) U.S. Cl. ..... 428/32.75; 428/32.79; 503/204

(58) Field of Classification Search ..... None
See application file for complete search history.

(56) References Cited

U.S. PATENT DOCUMENTS 5,639,447 A * 6/1997 Patel ..... 424/61
5,928,989 A * 7/1999 Ohnishi et al. ..... 503/227

FOREIGN PATENT DOCUMENTS

| | | | |
|---|---|---|---|
| JP | 8-85269 | | 4/1996 |
| JP | 08-085269 | * | 4/1996 |
| JP | 2000-272240 | | 10/2000 |
| JP | 2001-162937 | | 6/2001 |
| JP | 2002-285061 | | 10/2002 |
| JP | 2003094845 | * | 4/2003 |

* cited by examiner

*Primary Examiner*—Timothy M Speer
(74) *Attorney, Agent, or Firm*—Harness, Dickey & Pierce, PLC

(57) ABSTRACT

Disclosed is a printing method which can form an image having a rainbow color and a metallic luster at a low cost. The printing method comprises the steps of: providing a substrate; forming, on a surface of the substrate, a first image using a pigment- or dye-containing first colorant; and then forming a second image using a pearl pigment-containing second colorant.

15 Claims, 1 Drawing Sheet

PRINTING METHOD USING PEARL PIGMENT

BACKGROUND OF THE INVENTION

1. Field of the Invention

The present invention relates to a method for performing printing on a substrate using a pigment- or dye-containing first colorant and a pearl pigment-containing second colorant.

2. Background Art

Unlike ordinary pigments, pearl pigments are luster of pearls and have been utilized as printing inks, cosmetics, and various coating compositions by virtue of their safety, gloss, and feeling of high grade. Further, unlike aluminum powder having a metallic luster, this ink containing a pearl pigment exhibits a rainbow color with a silky sheen having a feeling of high grade. Therefore, images printed using this ink are said to have a rainbow color and a metallic luster at a certain viewing angle. By virtue of this nature, the pearl pigment has received great attention as a colorant in the printing industry. For example, Japanese Patent Laid-Open No. 85269/1996 describes that the utilization of a thermal transfer sheet having a thermally transferable ink layer containing a specific inorganic pearl pigment provides prints having a highly bright metallic luster.

This publication, however, does not propose any specific method for performing printing on a substrate using a pigment- or dye-containing colorant and a pearl pigment-containing colorant. Further, in this publication, there is no specific disclosure to the effect that an image, which is visually perceivable at one certain viewing angle but visually unperceivable at another certain viewing angle, can be printed on a substrate.

SUMMARY OF THE INVENTION

The present inventors have now found that an image having a rainbow color and a metallic luster can be formed at a low cost by using a pigment- or dye-containing colorant and a pearl pigment-containing colorant. The present invention has been made based on such finding.

Thus, according to one aspect of the present invention, there is provided a printing method comprising the steps of:

providing a substrate;

forming, on a surface of the substrate, a first image using a pigment- or dye-containing first colorant; and then forming a second image using a pearl pigment-containing second colorant.

According to another aspect of the present invention, there is provided a thermal transfer sheet comprising:

a substrate sheet;

a first colored layer comprising a pigment or a dye as a colorant; and a second colored layer comprising a pearl pigment as a colorant.

The utilization of the printing method and thermal transfer sheet according to the present invention can form, on a substrate, an image having a rainbow color and a metallic luster at a low cost. This can realize a printing method that can provide a printed image which is visually perceivable or unperceivable depending upon light reflection.

DESCRIPTION OF REFERENCE CHARACTERS

10: first colored layer part, 20: second colored layer part, 21: second colored layer, 22: peel layer, 30: protective layer part, 31: adhesive layer, 32: protective layer, 40: substrate sheet, 50: backside layer, and 60: release layer.

DETAILED DESCRIPTION OF THE INVENTION

1. Printing Method

According to the method of the present invention, an image having a rainbow color or a metallic gloss can be formed on a substrate. The method of the present invention can impart, to a printed image, the effect of rendering only an image formed using a pearl pigment-containing second colorant visually perceivable or unperceivable depending upon the viewing angle. Therefore, the printing method according to the present invention can form, on a substrate, for example, an image, which should distinguish the real from the false, an image, which should ensure security, and an image for improving design.

The printing method according to the present invention can be carried out, for example, by handwriting an image on a substrate using the pigment- or dye-containing first colorant and the pearl pigment-containing second colorant, by printing an image by means of a pen with an ink composition containing these colorants, by an ink jet recording method or a Bubble Jet (registered trademark) recording method utilizing an ink composition containing these colorants, or by a thermal transfer method using a thermal transfer sheet provided with these colorants. Among them, the thermal transfer method is preferred.

The first colorant and the second colorant utilized in the printing method according to the present invention may be the same as a colorant contained in a first colored layer and a colorant contained in a second colored layer, respectively, which will be described later. According to the present invention, the term "image" refers to an image which fall into a broad concept ranging from objects such as humans, animals, and articles or goods to characters, figures, symbols, etc.

Figure 1:
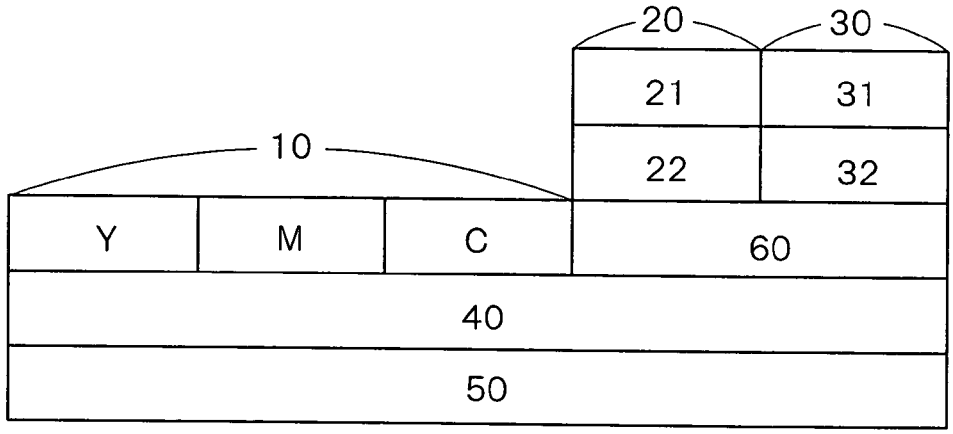
FIG. 1 is a diagram showing a thermal transfer sheet for use in the printing method according to the present invention.

The printing method according to the present invention will be described with reference to FIG. 1. FIG. 1 shows an embodiment of a thermal transfer sheet which can realize the printing method according to the present invention. In this thermal transfer sheet, a first colored layer part 10 comprising a pigment or a dye (yellow (Y), magenta (M), and cyan (C)) as a colorant, a second colored layer part 20 comprising a pearl pigment as a colorant, and a protective layer part 30 are provided in that order in a side-by-side relationship on a surface of a substrate sheet 40 stacked on a backside layer 50. The printing method according to the present invention may be carried out by loading a thermal transfer apparatus with this thermal transfer sheet, supplying image information from an external source to the apparatus, thermally transferring the first colored layer part 10 provided in the thermal transfer sheet based on the image information to form a first image on a substrate, and thermally transferring the second colored layer part 20 provided in the thermal transfer sheet to form a second image on the substrate. In a preferred embodiment of the present invention, in order to protect the image formed on the substrate, the protective layer part 30 provided in the thermal transfer sheet may be thermally transferred to form a protective part on the image. In another embodiment of the present invention, printing may be carried out using a thermal transfer sheet having the same construction as the thermal transfer sheet shown in FIG. 1 except that the position of the first colored layer part 10 and the second colored layer part 20 are reversed.

Utilization of Intermediate Thermal Transfer Sheet

In a preferred embodiment of the present invention, retransfer is carried out using an intermediate thermal transfer sheet comprising a substrate sheet and a transfer part provided separably on the substrate sheet, the transfer part comprising a receptive layer for receiving an image thermally transferred from the first colored layer or the second colored layer. The intermediate thermal transfer sheet may further optionally comprise a release layer and an adhesive layer. The release layer and the adhesive layer may be the same as those described in connection with the thermal transfer sheet.

Receptive Layer

The receptive layer is preferably formed of a material which can receive a colorant thermally transferred from the thermal transfer sheet comprising the first colored layer and the second colored layer. Specific examples of materials usable for constituting the receptive layer include: polyolefin resins such as polypropylene; halogenated resins such as polyvinyl chloride and polyvinylidene chloride; polyvinyl acetate; vinyl chloride-vinyl acetate copolymer; ethylene-vinyl acetate copolymer; acryl-styrene resin; and polyester resin. The receptive layer may contain a fluorescent agent described in connection with the thermal transfer sheet.

2. Thermal Transfer Sheet

The thermal transfer sheet according to the present invention basically comprises a substrate sheet, a first colored layer, and a second colored layer. In a preferred embodiment of the present invention, the thermal transfer sheet may further comprise a protective layer, a release layer, a peel layer, an adhesive layer, a backside layer and the like.

Substrate Sheet

Any sheet having a certain level of heat resistance and strength may be suitably used as the substrate sheet. Specific examples of preferred substrate sheets include: tissue papers such as glassine paper, capacitor paper, and paraffin paper; stretched or unstretched films of various plastics, for example, highly heat-resistant polyesters, such as polyethylene terephthalate, polyethylene naphthalate, polybutylene terephthalate, polyphenylene sulfide, polyether ketone, and polyether sulfone, polypropylene, polycarbonate, cellulose acetate, polyethylene derivatives, polyvinyl chloride, polyvinylidene chloride, polystyrene, polyamide, polyimide, polymethylpentene, and ionomers; and laminates of one or more of the above materials. The thickness of the substrate sheet may be properly selected depending upon materials for the substrate sheet so that the substrate sheet has proper strength, heat resistance and other properties. In general, however, the thickness is in the range of about 1 to 100 μm, preferably in the range of about 2 to 25 μm.

First Colored Layer

The first colored layer comprises a pigment or a dye as a colorant. The colorant includes at least one of magenta (M), cyan (C), yellow (Y), and black (Bk). The colorant may further include other color(s).

Regarding the pigment, both inorganic and organic pigments are usable without particular limitation. Examples of inorganic pigments usable herein include, in addition to titanium oxide and iron oxide, carbon blacks produced by known processes, such as contact, furnace, and thermal processes. Examples of organic pigments usable herein include azo pigments (including azo lake, insoluble azo pigment, condensed azo pigment, and chelate azo pigment), polycyclic pigments (for example, phthalocyanine, perylene, perinone, anthraquinone, quinacridone, dioxazine, thioindigo, isoindolinone, and quinophthalone pigments), dye chelates (for example, basic dye chelates and acid dye chelates), nitro pigments, nitroso pigments, and aniline black.

Various dyes, for example, direct dyes, acid dyes, foodstuff dyes, basic dyes, reactive dyes, disperse dyes, vat dyes, and soluble vat dyes may be used as the dye. The first colored layer may further contain dispersants, resins, waxes, adhesives, solvents and the like. The thickness of the first colored layer is preferably about 0.1 to 20 μm.

Second Colored Layer

The second colored layer contains a pearl pigment as a colorant. Pearl pigments include pearl essence extracted from fish and shellfish, basic lead carbonate, acid lead arsenate, bismuth oxychloride, and mica coated with a metal oxide. Among them, mica coated with a metal oxide is preferred from the viewpoint of safety. The metal oxide is preferably titanium oxide or iron oxide from the viewpoints of gloss and refractive index.

In the present invention, the pearl pigment may have further been colored with a pigment, a dye or the like. The second colored layer may contain wax, resin or the like. Waxes usable herein include microcrystalline wax, carnauba wax, and paraffin wax, Fischer-Tropsh wax, various types of low-molecular weight polyethylene, Japan wax, beeswax, spermaceti, insect wax, wool wax, shellac wax, candelilla wax, petrolactum, partially modified wax, fatty esters, and fatty amides. Resins usable herein include thermoplastic elastomers such as polyester resins, polyamide resins, polyolefin resins, acrylic resins, styrene resins, ethylene-vinyl acetate copolymers, and styrene-butadiene rubbers.

Preferably, the second colored layer comprises 10 to 90% by weight of a pearl pigment, 90 to 10% by weight of a resin, and 0 (zero) to 50% by weight of a wax. The above chemical composition of the second colored layer can reproduce a desired rainbow color or metallic luster, can improve resolution in printing, and can improve the strength of the colored layer. Consequently, the resultant image has improved rainbow color, metallic tone, glossy impression, (semi-) transparent impression, and resolution. The thickness of the second colored layer is preferably about 0.1 to 20 μm.

In a preferred embodiment of the present invention, the second colored layer containing a pearl pigment may further contain a fluorescent agent or a fluorescent brightening agent.

In the present invention, the presence of a pearl pigment as a colorant in either the first colored layer or the second colored layer suffices for the contemplated effect.

Protective Layer

In a preferred embodiment of the present invention, the thermal transfer sheet comprises a protective layer. More preferably, in the thermal transfer sheet, the protective layer is provided in an area where neither the first colored layer nor the second colored layer is provided. Specific examples of materials usable for forming the protective layer include polyester resins, polystyrene resins, acrylic resins, polyurethane resins, acrylated urethane resins, resins provided by modifying the above resins with silicone, mixtures of the above resins, ionizing radiation-curable resins, and ultraviolet screening resins. If necessary, ultraviolet absorbers, organic fillers and/or inorganic fillers may be properly added to the protective layer.

The protective layer formed using the ionizing radiation-curable resin is particularly excellent in plasticizer resistance and scratch resistance. Specifically, for example, a resin formed by crosslinking and curing a radically polymerizable polymer or oligomer through ionizing radiation irradiation and, if necessary, adding a photopolymerization initiator thereto, and then performing polymerization crosslinking by applying an electron beam or ultraviolet light may be used as the resin for constituting the protective layer.

The protective layer containing an ultraviolet screening resin or an ultraviolet absorber mainly functions to impart lightfastness to prints. An example of the ultraviolet screening resin usable herein is a resin formed by reacting a reactive ultraviolet absorber with a thermoplastic resin or the above-described ionizing radiation-curable resin to bond the ultraviolet absorber to the resin. More specifically, the ultraviolet screening resin may be, for example, a resin produced by introducing a reactive group, such as an addition-polymerizable double bond (for example, a vinyl, acryloyl, or methacryloyl group) or an alcoholic hydroxyl, amino, carboxyl, epoxy, or isocyanate group into a nonreactive organic ultraviolet absorber, for example, a salicylate, phenyl acrylate, benzophenone, benzotriazole, coumarin, triazine, or nickel chelate. Specific examples of ultraviolet absorbers include nonreactive organic ultraviolet absorbers, salicylate, phenyl acrylate, benzophenone, benzotriazole, coumarin, triazine, or nickel chelate.

Specific examples of organic fillers and/or inorganic fillers usable herein include, but are not particularly limited to, polyethylene wax, bisamide, nylon, acrylic resin, crosslinked polystyrene, silicone resin, silicone rubber, talc, calcium carbonate, titanium oxide, and finely divided silica such as microsilica and colloidal silica.

Preferably, the organic filler and/or the inorganic filler have good slipperiness and have a particle diameter of not more than 10 μm, more preferably in the range of about 0.1 to 3 μm. The amount of the organic filler and/or the inorganic filler added is preferably such that the thermally transferred protective layer can be kept transparent, specifically in the range of 0 (zero) to 100 parts by mass based on 100 parts by mass of the above resin component. The thickness of the protective layer may be properly determined by the type of the resin for protective layer formation. In general, however, the thickness of the protective layer is about 0.5 to 10 μm.

Peel Layer

In the thermal transfer sheet according to the present invention, a peel layer or a release layer may be provided. Preferably, a peel layer is provided between the substrate sheet and the second colored layer. The peel layer can improve the adhesion between the second colored layer and the substrate sheet. The peel layer may be formed of, for example, the above-described wax or resin. In a preferred embodiment of the present invention, the peel layer may contain a fluorescent agent. The fluorescent agent is a material which emits fluorescence upon exposure to ultraviolet light. The fluorescent agent may be inorganic or organic and may have or may not have an absorption band in the visible region. Specific examples of inorganic fluorescent agents include those prepared by providing, as a main component, crystals of an oxide, sulfide, silicate, phosphate, tungstate or the like of calcium (Ca), barium (Ba), magnesium (Mg), zinc (Zn), cadmium (Cd) and the like, adding, as an activator, metallic elements such as magnesium, silver (Ag), copper (Cu), antimony (Sb), and lead (Pb) or rare earth elements such as lanthanides to the main component, and firing the mixture. Organic fluorescent agents include diaminostilbenzylsulfonic acid derivatives, imidazole derivatives, coumarin derivatives, derivatives of triazole, carbazole, pyridine, naphthalic acid, imidazolone and the like, colorants such as fluorescein and eosin, and condensed ring-containing compounds such as anthracene. The thickness of the peel layer is preferably about 0.05 to 5 μm.

Release Layer

In the thermal transfer sheet according to the present invention, a release layer may be provided. Preferably, the release layer may be provided so as to underlie the second colored layer or the protective layer. The release layer may be formed of a release agent. Specific examples of release agents include various waxes, such as polyethylene wax and paraffin wax, higher aliphatic alcohols, organopolysiloxanes, anionic surfactants, cationic surfactants, amphoteric surfactants, nonionic surfactants, fluorosurfactants, organic carboxylic acids and derivatives thereof, fluororesins, silicone resins, and fine particles of inorganic compounds such as talc and silica. The thickness of the release layer is preferably about 0.05 to 5 μm.

Adhesive Layer

In the thermal transfer sheet according to the present invention, an adhesive layer may be provided. Preferably, the adhesive layer is provided on the surface of at least one of the first colored layer, the second colored layer, and the protective layer. The adhesive layer may be formed of any adhesive. The adhesive, however, is preferably one prepared by dispersing thermoplastic resin particles having a minimum film-forming temperature of about 50 to 100° C. and having a diameter of 0.1 to 10 μm in a heat-fusible wax. The thickness of the adhesive layer may be about 0.1 to 10 μm.

In a more preferred embodiment of the present invention, the adhesive layer may contain a colorant (a pigment or a dye). The amount of the colorant added is preferably about 1 to 50% by weight based on the total weight of the adhesive layer composition.

Backside Layer

In a preferred embodiment of the present invention, a backside layer may be provided on the backside of the substrate sheet. The backside layer can function to prevent heat fusing between a heating device such as a thermal head and the substrate sheet and to improve smooth carriability of the thermal transfer sheet. Specific examples of resins usable in the backside layer include naturally occurring or synthetic resins, for example, cellulosic resins such as ethylcellulose, hydroxycellulose, hydroxypropylcellulose, methylcellulose, cellulose acetate, cellulose butyrate and nitrocellulose, vinyl resins such as polyvinyl alcohol, polyvinyl acetate, polyvinyl butyral, polyvinyl acetal, and polyvinyl pyrrolidone, acrylic resins such as polymethyl methacrylate, polyethyl acrylate, polyacrylamide, and acrylonitrile-styrene copolymers, polyamide resins, polyvinyltoluene resins, coumarone-indene resins, polyester resins, polyurethane resins, and silicone-modified or fluorine-modified urethanes. They may be used either solely or as a mixture of two or more.

In a preferred embodiment of the present invention, the backside layer has both heat-resistance and slipperiness (hereinafter often referred to as "heat-resistant slip layer"). A specific example of the heat-resistant slip layer is preferably formed by adding a crosslinking agent such as polyisocyanate and a surfactant, preferably a phosphorus surfactant, to a hydroxyl functional group-containing resin among the above resins. The thickness of the backside layer is about 0.1 to 10 μm, preferably about 0.5 to 5 μm.

3. Preparation of Thermal Transfer Sheet

The thermal transfer sheet according to the present invention may be prepared as a sheet comprising a substrate sheet having on its surface only the first colored layer and as a sheet comprising a substrate sheet having on its surface only the second colored layer. In this case, at the time of thermal transfer, these sheets may be used in combination. In a preferred embodiment of the present invention, the thermal transfer sheet according to the present invention is formed as a sheet having a layer construction of the substrate sheet and, provided on the surface of the substrate sheet in the following order, the first colored layer, the second colored layer, and optionally the protective layer, or as a sheet having a layer construction of the substrate sheet and, provided on the surface of the substrate sheet in the following order, the second colored layer, the first colored layer, and optionally the protective layer. Further, in a preferred embodiment of the present invention, when the first colored layer, the second colored layer, and the protective layer are provided in a side-by-side relationship on the substrate sheet, the release layer, the peel layer, and the adhesive layer may be formed on the upper or lower surface of these layers. The first colored layer, the second colored layer, and the protective layer may be formed on the substrate sheet by coating compositions for the respective layers by hot-melt coating, hot lacquer coating, gravure direct coating, gravure reverse coating, knife coating, air coating, or roll coating.

4. Use of Printing Method According to the Present Invention

The printing method according to the present invention may be utilized for the formation of an image, to which a rainbow color and a metallic luster have been imparted, on a substrate. Specific examples of uses of the printing method according to the present invention include: printing of photograph-like images of a face, letters and the like onto identity certifications or ID cards, credit cards and other cards; composite photographs and commemorative photographs, for example, in amusement facilities, such as amusement parks, game centers (amusement arcades), museums, and aquaria; and the like.

EXAMPLES

The following Examples further illustrate the present invention. The present invention, however, is not to be construed as being limited thereto.

Example 1

Preparation of Thermal Transfer Sheet 1

1. Backside Layer (Heat-resistant Slip Layer)

A composition for heat-resistant slip layer formation was prepared according to the following formulation. This composition was gravure coated at a coverage of 1.0 g/m$^2$ onto the backside of a substrate sheet formed of polyethylene terephthalate (PET) to form a heat-resistant slip layer as shown in FIG. 1.

| Heat-resistant slip layer | |
|---|---|
| Polyvinyl butyral | 3.6 pts. wt. |
| Polyisocyanate | 8.6 pts. wt. |
| Phosphoric ester surfactant | 2.8 pts. wt. |
| Talc | 0.7 pt. wt. |
| Methyl ethyl ketone | 32.0 pts. wt. |
| Toluene | 32.0 pts. wt. |

2. First Colored Layer Part

Compositions for first colored layer formation were prepared according to the following formulations. These compositions each were gravure coated at a coverage of 0.8 g/m$^2$ in a side-by-side relationship onto the substrate sheet in its side remote from the heat-resistant slip layer in the order of Y, M, and C to form a first colored layer part as shown in FIG. 1.

| Yellow composition | |
|---|---|
| Quinophthalone dye | 6.0 pts. wt. |
| Polyvinyl acetoacetal resin (KS-5, manufactured by SEKISUI CHEMICAL CO., LTD.) | 3.0 pts. wt. |
| Toluene | 45 pts. wt. |
| Methyl ethyl ketone | 45 pts. wt. |
| **Magenta composition** | |
| Pyrazolotriazole azomethine dye | 4.4 pts. wt. |
| Anthraquinone dye | 1.0 pt. wt. |
| Polyvinyl acetoacetal resin (KS-5, manufactured by SEKISUI CHEMICAL CO., LTD.) | 3.0 pts. wt. |
| Toluene | 45 pts. wt. |
| Methyl ethyl ketone | 45 pts. wt. |
| **Cyan composition** | |
| Indoaniline dye | 4.0 pts. wt. |
| Anthraquinone dye | 1.0 pt. wt. |
| Polyvinyl acetoacetal resin (KS-5, manufactured by SEKISUI CHEMICAL CO., LTD.) | 3.0 pts. wt. |
| Toluene | 45 pts. wt. |
| Methyl ethyl ketone | 45 pts. wt. |

3. Second Colored Layer Part

Release Layer

A composition for release layer formation was prepared according to the following formulation. This composition was gravure coated at a coverage of 0.5 g/m$^2$ on the surface of the above substrate sheet in a side-by-side relationship with the first colored layer part to form a release layer.

| | |
|---|---|
| Polyvinyl alcohol resin | 2.0 pts. wt. |
| Urethane emulsion resin | 2.6 pts. wt. |
| Isopropyl alcohol | 63.6 pts. wt. |
| Ion-exchanged water | 31.8 pts. wt. |

Peel Layer

A composition for peel layer formation was prepared according to the following formulation. This composition was gravure coated at a coverage of 0.8 g/m$^2$ on the surface of the release layer to form a peel layer.

| | |
|---|---|
| Polymethyl methacrylate resin (BR-87, manufactured by Mitsubishi Rayon Co., Ltd.) | 30 pts. wt. |
| Benzoxazole dye (Uvitex OB, manufactured by Ciba Specialty Chemicals K.K.) | 2.6 pts. wt. |
| Toluene | 35 pts. wt. |
| Methyl ethyl ketone | 35 pts. wt. |

Second Colored Layer

A composition for second colored layer formation was prepared according to the following formulation. This composition was gravure coated at a coverage of 1.4 g/m$^2$ on the surface of the peel layer to form a second colored layer.

| | |
|---|---|
| Vinly chloride-vinyl acetate copolymer resin (VYLF-X, manufactured by Union Carbide) | 21 pts. wt. |
| Pearl pigment (Iriodin/Afflair 223, manufactured by Merc Japan) | 21 pts. wt. |
| Toluene | 29 pts. wt. |
| Methyl ethyl ketone | 29 pts. wt. |

4. Protective Layer Part

Release Layer

A release layer was formed on the surface of the substrate sheet as described above in "3. Second colored layer part," in a side-by-side relationship with the above-formed release layer.

Protective Layer

A composition for protective layer formation was prepared according to the following formulation. This composition was gravure coated at a coverage of 1.4 g/m$^2$ on the surface of the release layer formed just above to form a protective layer.

| | |
|---|---|
| Polymethyl methacrylate resin (BR-87, manufactured by Mitsubishi Rayon Co., Ltd.) | 30 pts. wt. |
| Polyethylene wax | 1.2 pts. wt. |
| Toluene | 35 pts. wt. |
| Methyl ethyl ketone | 35 pts. wt. |

Adhesive Layer

A composition for adhesive layer formation was prepared according to the following formulation. This composition was gravure coated at a coverage of 1.2 g/m$^2$ on the surface of the protective layer to form an adhesive layer.

| | |
|---|---|
| Vinly chloride-vinyl acetate copolymer resin | 30 pts. wt. |
| Toluene | 35 pts. wt. |
| Methyl ethyl ketone | 35 pts. wt. |

Example 2

Preparation of Thermal Transfer Sheet 2

Figure 2:
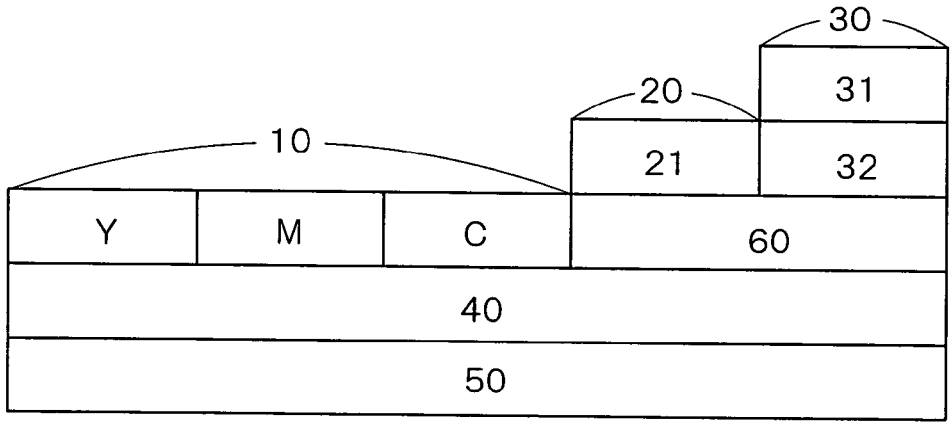
FIG. 2 is a diagram showing a thermal transfer sheet having the same construction as the thermal transfer sheet shown in FIG. 1 except that the second colored layer has been provided directly on a release layer.

A thermal transfer sheet 2 as shown in FIG. 2 was prepared in the same manner as in Example 1, except that no peel layer was formed in the second colored layer part and the second colored layer was formed as follows.

Second Colored Layer

A composition for second colored layer formation was prepared according to the following formulation. This composition was gravure coated at a coverage of 1.4 g/m$^2$ on the surface of the release layer to form a second colored layer.

| | |
|---|---|
| Vinly chloride-vinyl acetate copolymer resin (VYLF-X, manufactured by Union Carbide) | 21 pts. wt. |
| Pearl pigment (Iriodin/Afflair 201, manufactured by Merc Japan) | 21 pts. wt. |
| Benzoxazole dye (Uvitex OB, manufactured by Ciba Specialty Chemicals K.K.) | 3.0 pts. wt. |
| Toluene | 30 pts. wt. |
| Methyl ethyl ketone | 30 pts. wt. |

Example 3

Preparation of Thermal Transfer Sheet 3

Figure 3:
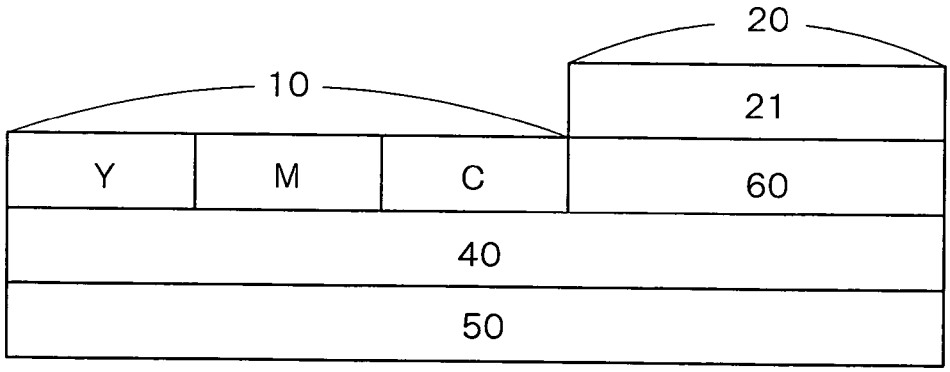
FIG. 3 is a diagram showing a thermal transfer sheet having the same construction as the thermal transfer sheet shown in FIG. 2 except that a protective layer part has not been formed.

A thermal transfer sheet 3 as shown in FIG. 3 was prepared in the same manner as in Example 2, except that the protective layer part was not formed.

Example 4

Preparation of Intermediate Transfer Medium

An intermediate transfer medium comprising a substrate sheet, a peel layer, and a receptive layer was prepared as follows.

Peel Layer

A composition for peel layer formation was prepared according to the following formulation. This composition was gravure coated at a coverage of 0.8 g/m$^2$ onto a surface of a substrate sheet formed of polyethylene terephthalate (PET) to form a peel layer.

| | |
|---|---|
| Acrylic resin (BR-83, manufactured by Mitsubishi Rayon Co., Ltd.) | 88 pts. wt. |
| Polyester resin | 1 pt. wt. |
| Polyethylene wax | 11 pts. wt. |
| Methyl ethyl ketone | 50 pts. wt. |
| Toluene | 50 pts. wt. |

Receptive Layer

A composition for receptive layer formation was prepared according to the following formulation. This composition was gravure coated at a coverage of 1.5 g/m$^2$ onto the surface of the peel layer to form a receptive layer.

| | |
|---|---|
| Vinly chloride-vinyl acetate copolymer resin (VYLF-X, manufactured by Union Carbide) | 21 pts. wt. |
| Acrylic silicone | 2.0 pts. wt. |
| Toluene | 50 pts. wt. |
| Methyl ethyl ketone | 50 pts. wt. |

Evaluation Test

Evaluation 1: Direct Transfer Test

A thermal transfer apparatus (a card printer P 310, manufactured by ELTRON) was loaded with the thermal transfer sheets 1 to 3. Electric signals provided by analyzing a photograph of a woman's face and characters were transmitted to a thermal head provided in the thermal transfer apparatus to perform thermal transfer onto an image-receiving sheet (a white resin card) having the following composition. Specifically, the first colored layer part was first thermally transferred to form a full-color image of the woman's face. Next, the second colored layer part was thermally transferred to form a character image on the upper part of the full-color image. Thereafer, a protective layer was formed on the upper part of the image formed by the thermal transfer of the second colored layer part to prepare image formed cards in which the full-color image of a woman's face had been provided integrally with the character image formed by the pearl pigment.

| Image-receiving sheet | |
|---|---|
| Polyvinyl chloride composition (Degree of polymerization 800; containing about 10% by weight of additives (such as a stabilizer)) | 100 pts. wt. |

-continued

| Image-receiving sheet | |
|---|---|
| White pigment (titanium oxide) | 10 pts. wt. |
| Plasticizer (DOP) | 0.5 pt. wt. |

Evaluation 2: Intermediate Transfer Test

A thermal transfer apparatus (a card printer P 310, manufactured by ELTRON) was loaded with the thermal transfer sheets 1 to 3 and the following intermediate transfer medium, and cards, in which images had been formed on the image-receiving sheet (white resin card), were prepared. Electric signals provided by analyzing a photograph of a woman's face and characters were first transmitted to a thermal head provided in the thermal transfer apparatus to perform thermal transfer onto the intermediate transfer medium in its receptive layer face. Specifically, the first colored layer part was thermally transferred to form a full-color image of the woman's face. Next, the second colored layer part was thermally transferred to form a character image on the upper part of the full-color image. Thereafter, thermal transfer was carried out from the intermediate thermal transfer medium having an image-formed receptive layer in its backside onto the image-receiving sheet to prepare image formed cards in which the full-color image of a woman's face had been provided integrally with the character image formed by the pearl pigment.

Evaluation Results

All the image-formed cards prepared in evaluation tests 1 and 2 were visually inspected at various viewing angles. As a result, at viewing angles which had allowed the character image formed by the pearl pigment to be visually unperceivable due to light reflection, only the full-color image of the woman's face could be visually perceived. On the other hand, at viewing angles which had allowed the character image formed by the pearl pigment to be visually perceivable by light reflection, the character image formed by the pearl pigment was visually perceived on the surface of the full-color image of the woman's face.

The invention claimed is:

1. A printing method by thermal transfer using a thermal transfer sheet comprising the steps of:

providing a substrate and the thermal transfer sheet comprising a substrate sheet, a pigment- or dye-containing first colorant and a pearl pigment-containing second colorant in this order side by side provided on a surface of the substrate sheet;

forming, on a surface of the substrate, a first image using the first colorant; and forming a second image using the second colorant which further comprises a fluorescent agent or a fluorescent brightening agent wherein the thermal transfer method comprises the thermal transfer of the first colorant and/or the second colorant onto an intermediate thermal transfer sheet.

2. A printing method by thermal transfer using a thermal transfer sheet, comprising the steps of:

providing a substrate and a thermal transfer sheet comprising a substrate sheet, a pearl pigment-containing first colorant and a pigment- or dye-containing second colorant in this order side by side provided on a surface of the substrate sheet;

forming, on a surface of the substrate, a first image using the first colorant which further comprises a fluorescent agent or a fluorescent brightening agent; and forming a second image using the second colorant;

wherein the thermal transfer method comprises the thermal transfer of the first colorant and/or the second colorant onto an intermediate thermal transfer sheet.

3. The method according to claim 1 or 2, wherein said pearl pigment comprises mica having a surface coated with a metal oxide.

4. The method according to claim 3, wherein said metal oxide is titanium oxide and/or iron oxide.

5. A thermal transfer sheet for use in a printing method by thermal transfer, comprising:

a substrate sheet;

a first colored layer comprising a pigment or a dye as a colorant; and a second colored layer comprising a pearl pigment as a colorant, and a fluorescent agent or a fluorescent brightening agent;

the first colored layer and the second colored layer in this order side by side being provided on a surface of the substrate sheet;

wherein the thermal transfer method comprises the thermal transfer of the first colorant and/or the second colorant onto an intermediate thermal transfer sheet.

6. The thermal transfer sheet according to claim 5, wherein said pearl pigment is one according to claim 3.

7. The thermal transfer sheet according to claim 5, wherein a release layer or a peel layer is provided between the substrate sheet and the second colored layer.

8. The thermal transfer sheet according to claim 7, wherein said peel layer contains a fluorescent agent.

9. The thermal transfer sheet according to claim 5, which further comprises a release layer provided between the substrate sheet and a protective layer.

10. The thermal transfer sheet according to claim 9, wherein an adhesive layer is provided on the surface of any one of the first colored layer, the second colored layer, and the protective layer.

11. The thermal transfer sheet according to claim 9 which has a layer construction of the substrate sheet and, provided on the surface of the substrate sheet in the following order, the first colored layer, the second colored layer, and the protective layer, or which has a layer construction of the substrate sheet and, provided on the surface of the substrate sheet in the following order, the second colored layer, the first colored layer, and the protective layer.

12. The thermal transfer sheet according to claim 9, which further comprises a release layer provided between the substrate sheet and the protective layer.

13. The thermal transfer sheet according to claim 5, which further comprises a backside layer provided on the backside of the substrate sheet.

14. A method for image formation, comprising the steps of:

providing the thermal transfer sheet according to any one of claims 5 to 11; and forming an image on a substrate by thermal transfer using the thermal transfer sheet.

15. A method for image formation on a substrate using a thermal transfer sheet and an intermediate thermal transfer sheet, comprising the steps of:

providing a thermal transfer sheet comprising a first colored layer or a second colored layer, and an intermediate transfer sheet comprising a receptive layer;

forming an image on the receptive layer in the intermediate transfer sheet by thermal transfer using the thermal transfer sheet; and thermally transferring the receptive layer with the image transferred thereon, from its side on which the image has not been formed, onto the substrate to form an image on the substrate.

* * * * *